US005201367A

United States Patent [19]

Dubrovsky et al.

[11] Patent Number: 5,201,367

[45] Date of Patent: Apr. 13, 1993

[54] STACK OF PLATES FOR A PLATE-AND-TUBE HEAT EXCHANGER WITH DIVERGING-CONVERGING PASSAGES

[76] Inventors: Evgeny V. Dubrovsky, ulitsa Chaikovskogo, 18, kv. 203, Moscow; Alexandr A. Kopylov, ulitsa Sukhareva, 36, kv. 55, Orenburg; Vladimir P. Nagornov, ulitsa Turkestanskaya, 41, kv. 120, Orenburg; Leonid A. Averkiev, ulitsa Gagarina, 40a, kv. 137, Orenburg, all of U.S.S.R.

[21] Appl. No.: 778,103

[22] PCT Filed: Feb. 20, 1990

[86] PCT No.: PCT/SU90/00047

§ 371 Date: Dec. 13, 1991

§ 102(e) Date: Dec. 13, 1991

[87] PCT Pub. No.: WO91/13309

PCT Pub. Date: Sep. 5, 1991

[51] Int. Cl.[5] ..... F28F 1/32

[52] U.S. Cl. ..... 165/151; 165/182

[58] Field of Search ..... 165/151, 182

[56] References Cited

U.S. PATENT DOCUMENTS

| | | | |
|---|---|---|---|
| 1,920,313 | 8/1933 | Mautsch | 165/151 |
| 3,650,233 | 3/1972 | Young et al. | 113/1 C |
| 3,698,222 | 10/1972 | Blake | 72/129 |
| 4,586,563 | 5/1986 | Dubrovsky et al. | 165/151 |
| 4,592,420 | 6/1986 | Hughes | 165/151 |

FOREIGN PATENT DOCUMENTS

| | | | |
|---|---|---|---|
| 3043219 | 12/1982 | Fed. Rep. of Germany . | |
| 61-246595 | 11/1986 | Japan | 165/151 |
| 61-268987 | 11/1986 | Japan | 165/151 |
| 63-99495 | 4/1988 | Japan | 165/151 |
| 79/00041 | 2/1981 | PCT Int'l Appl. . | |
| 775608 | 10/1980 | U.S.S.R. . | |
| 794354 | 1/1981 | U.S.S.R. . | |
| 1207591 | 1/1986 | U.S.S.R. . | |
| 382099 | 10/1932 | United Kingdom | 165/151 |

OTHER PUBLICATIONS

Dubrovsky E. V., Dunayev V. P., Kuzin A. I., Martynova N. I. "Perfection of designs of heat exchangers for tractors and combine harvesters"/Sovershenstvovanye konstruktsii teploobmennikov dlya traktorov i combainov/, Traktory i Selkhozmashiny, No. 8, pp. 2-8, 1985, USSR.

Babichev Z. V. "Production of Automotive Radiators"/Proizvodstov avtomobilnykh radiatorov/, 1958, Gosudar-stvennoe Nauchno-Technicheskoye Izdatelstvo Mashino-stroitelnoi Literatury/Moscow, p. 111.

*Primary Examiner*—Allen J. Flanigan

*Attorney, Agent, or Firm*—Keck, Mahin & Cate

[57] ABSTRACT

A stack comprises plates (1,2,3,4) having a zig-zag profile and defining diverging-converging passages in the flow direction (L) of the first heat-exchange medium. Each plate (1,2,3,4) has in the direction (M) perpendicular to the flow direction (M) of the first medium several rows (10) of equally spaced openings (11) accommodating tubes (11a) for a flow of the second heat-exchange medium. Each plate (1,2,3,4) has an odd number of portions (12,13) whose zig-zag profile is offset with respect to the zig-zag profile of the adjoining portion by one half of the pitch (t) of the zig-zag pattern of the profile. The rotary die set for producing the plates of this stack comprises two die rolls (19,20). The length of the evolution of the shaping surface (21,22) of each roll (19,20) is divided into an even number of portions of the same length. The zig-zag profile of each portion is offset with respect to the zig-zag profiles of the adjoining portions through one half of the pitch of the zig-zag pattern of the profile.

1 Claim, 8 Drawing Sheets

STACK OF PLATES FOR A PLATE-AND-TUBE HEAT EXCHANGER WITH DIVERGING-CONVERGING PASSAGES

TECHNICAL FIELD

The invention relates to heat-exchange technology, and more particularly it relates to a stack of plates for a plate-fin heat exchanger with diverging-converging passages, and to a rotary die set for manufacturing plates for this stack.

PRIOR ART

One known prior art design involves a stack of plates for a plate-and-tube heat exchanger with diverging-converging passages (PCT/SU, 79/00041) intended for water-to-air heat exchangers in motor vehicles and the radiators of diesel locomotives. This design of a stack of plates for a plate-and-tube heat exchanger with diverging-converging passages includes a plurality of stacked plates having a zig-zag profile and defining passages in the direction of the flow of the first heat-exchange medium, the profile of each passage being a succession of alternating diverging and converging portions, each plate having, in the direction perpendicular to the flow of the first medium, at least one row of uniformly spaced openings which accommodate tubes for the flow of the other heat-exchange medium. In other words, the stack is made up of plates of two types, the plates of these two types differing from each other in that, in the assembled stack, the zig-zag profile of the plates of the first type is offset from the zig-zag profile of the plates of the second type in the flow direction of the first medium by one half of the pitch of the zig-zag pattern, the zig-zag profile of each individual plate being the same throughout its length.

The stack of plates for a heat exchanger with diverging-converging passages features high heat-transfer and hydraulic efficiency; thus, in comparison with a stack of plates for a plate-and-tube heat exchanger with either plain or sinuous passages of a similar geometry, it allows halving the volume of the stack and reducing its weight to one half or even one fourth the weight of a conventional stack in a water radiator of a tractor or combine harvester engine, with other conditions being equal (Dubrovsky E. V. Dunayev V. P., Kuzin A. I., Martynova N. I. "Perfection of designs of heat exchangers for tractors and combine harvesters" /Sovershenstovovanye konstruktsii teploobmennikov dlya traktorov i combainov/, Traktory i Selkhozmashiny, No. 8, pp. 2–8, 1985, USSR). This is due to the fact that the walls of diverging-converging passages generate and propagate in the wall-adjoining layer of the heat-carrier flow recurring three-dimensional vortexes which are weakly diffused into teh nucleus of the flow. Consequently, the amount of turbulent heat conductivity and transfer of the heat-carrier flow in its wall-adjoining layer rises several times, and its turbulent viscosity likewise grows. Hence, the growth of the heat transfer coefficient in diverging-converging passages either surpasses or is equal to the growth of the pressure loss factor therein, in comparison with either plain or sinuous passages of a similar geometry, with other conditions being equal. This physical situation may be illustrated by an expression:

$$\frac{\alpha_1}{\alpha_2} \geqq \frac{\xi_1}{\xi_2} \quad (1)$$

where $\alpha_1$, $\alpha_2$ are, respectively, the coefficients of heat transfer in diverging-converging and plain passages; and $\xi_1$, $\xi_2$ are the respective pressure loss factors in diverging-converging and plain passages.

In water-to-air radiators, the coefficient K of heat transfer is about equal quantitatively to the coefficient $\alpha$ of heat transfer of the air-engaging heat-exchange surface of the radiator ($K \approx \alpha$). Thus, the feasibility of intensifying the heat exchange in a stack of a water-to-air late-and-tube heat exchanger with diverging-converging passages is practically completely defined by the above expression (1), which can be illustrated by another expression.

$$\frac{K_1}{K_2} \geqq \frac{\Delta P_1}{\Delta P_2}, \quad (2)$$

where $K_1$, $K_2$ are, respectively, the heat transfer coefficients of water-to-air radiators with diverging-converging and plain passages;

$\Delta P_1$, $\Delta P_2$ are the respective air resistance values of water-to-air radiators with diverging-converging and plain passages.

As a stack of plates for a plate-and-tube heat exchanger with diverging-converging passages is made of plates of two types, the manufacturing of the stack in a mass production environment is based on two automatic lines built about rotary die sets. Each automatic line comprises a coil holder accommodating a coil of a plain strip stock, operable to pay out the strip in a predetermined mode. The plain strip is directed from the coil holder into a straightening-beating unit where the plain strip is straightened and its edges are beaded (rolled-in). Then the plain strip is fed into a rotary die set where a plurality of openings are pierced in the strip, and the edges of the openings are raised (flanged). This operation is accompanied by shaping the zig-zag transverse profile. The operation is performed by a rotary die set for manufacturing the plates of a plate-and-tube heat exchanger with diverging-converging passages (Babichev Z. V. "Production of Automotive Radiators" /Proizvodstvo avtomobilnykh radiatorov/, 1958, Gosudarstvennoe Nauchno-Technicheskoye Izdatelstvo Mashinostroitelnoi Literatury /Moscow/, p. 111), comprising two die rolls with parallel geometric axes, mounted for rotation in opposing directions, the shaping surface of each roll defining zig-zag lines in intersection with a plane including the axes of the rolls, the shaping or die surface of one of the rolls having along its directrix at least one row of radial male punches uniformly spaced about the shaping surface of this roll, and the shaping or die surface of the other roll having matching female die recesses. The shaping of each roll has a zig-zag profile whose parameters are permanent over the entire evolution of this surface.

The two automatic lines are different in the exact design of the rolls of their rotary die sets, so that the rolls of one automatic line shape the strip into the transverse zig-zag profile which is offset by one half of the pitch of the zig-zag pattern with respect to the transverse zig-zag profile of the strip shaped by the rolls of the rotary die set of the other line. Thus, the strip shaped into the zag profile and having the flanged openings made therein leaves the respective die set and is fed stepwise into the cutting unit where it is cut by a disc blade into plates of the required length. The cut plates from the two automatic lines are fed alternatingly into the heat-exchanger stack assembly bay including a unit with a holder having the set of the tubes placed thereon, and an apparatus for setting the plates onto the tubes with the required spacing of the stacked plates. The outer surface of each tube is coated in advance with a layer of a solder, so that the tubes are soldered with the plates in the heat-exchanger stack as the latter is carried through a sintering oven.

The flanged openings of adjoining plates in the heat-exchanger stack are shaped by the male punches and female die recesses on the shaping surfaces of the rolls of the two different die sets. In this situation the matching alignment of the opposing openings in each pair of adjoining plates in the stack is somewhat disturbed on account of the different positions of the matching male punches and female recesses on the shaping surfaces of the respective pairs of rolls of the two die sets within the sum of the tolerances for their relative positions.

Consequently, as the plates are set onto the tubes, the edges of the flanged openings of the plates engage the outer surfaces of the tubes not over their entire surfaces; in other words, crescent-shaped gaps are formed between the flanges of the openings and the outer surfaces of the tubes. These crescent-shaped gaps would not be filled up with the solder in the sintering operation, so that the thermal contact in the areas of the crescent-shaped gaps between the edges of the flanged openings in the plates and the outer surfaces of the tubes is impaired, which ultimately results in the impaired heat-transfer efficiency of the heat-exchanger stack. Practical experience has shown that the non-engagement of the perimeters of the outer surfaces of the tubes with the flanged openings of the plates can be as high as 25%, reducing the heat-transfer efficiency of the stack of the heat exchanger by as much as 15%.

The manufacture of the heat exchanger of the above-described design involves the use of two automatic lines whose cost is relatively high. Moreover, the production cost of this heat exchanger is also increased on account of the great production space required.

DISCLOSURE OF THE INVENTION

The object of the present invention is to create a stack of plates for a plate-and-tube heat exchanger with diverging-converging passages, wherein the improved design of each plate and the enhanced accuracy of matching alignment of opposing openings in adjoining plates should enhance the heat transfer efficiency of the stack of a heat exchanger, and also to create a rotary die set wherein the design of the rolls should provide for producing the plates for the heat-exchanger stack by a single rotary die set.

This object is attained in a stack of plates for a plate-and-tube heat exchanger with diverging-converging passages, comprising a plurality of stacked plates having a zig-zag profile and defining in the direction of the flow of the first heat-exchange medium the passages for its flow, the profile of each passage being a succession of alternating diverging and converging portions, each plate having in the direction perpendicular to the flow direction of the first medium at least one row of uniformly spaced openings accommodating therein tubes for the flow of the second heat-exchange medium, in which stack, in accordance with the invention, each plate has in the direction perpendicular to the flow direction of the first medium an odd number of portions of the same length, the zig-zag profile of each portion being offset with respect to the zig-zag profile of the adjoining portion of the same plate by one half of the pitch of the zig-zag pattern of the profile in the flow direction of the first medium and communicating with the last-mentioned portion through a transition zone, the length of each portion being a multiple of the spacing of the axes of the openings in one and the same row.

To produce the plates of the stack of plates for a plate-and-tube heat exchanger with diverging-converging passages of the disclosed type, there is employed a rotary die set comprising two die rolls mounted for rotation about parallel geometric axes in opposite directions, the shaping surface of each die roll defining zig-zag lines in intersection with a plane including the geometric axes of the rolls, the shaping surface of one of the rolls having along the directrix thereof at least one row of radial male punches uniformly spaced about the shaping surface of the roll, and the shaping surface of the other roll having female die recesses matching the male punches. The length of the evolution of the shaping surface of each roll is divided into an even number of portions of the same length by transition zones joining these portions, adapted to shape the transition zones joining the adjacent portions in the plates, the zig-zap profile of each portion being offset with respect to the zig-zag profiles of the adjoining portions of the sample shaping surface by one half of the pitch of the zig-zag pattern of the profile. The length of each portion is a multiple of the spacing of the male punches in one and the same row.

The disclosed design of the stack of plates for a plate-and-tube heat exchanger with diverging-converging passages allows employment of a single automatic line for the production of this stack, wherein the rotary die set has the disclosed design of the die rolls. In this case the flanged openings of the pairs of adjoining plates in the stack of the heat exchanger are shaped by the male punches and female die recesses of the die rolls of one and the same die set. This enhances the accuracy of the matching alignment of the opposing openings in adjacent plates, as the error of their matching alignment is determined by the single tolerance zone of the relative arrangement of the male punches and female die recesses on the shaping surfaces of one and the same pair of rolls. Consequently, when the plates are set upon the tubes, the non-engagement of the flanged edges of the openings with the outer surfaces of the tubes is sharply decreased. Practical experience has proven that the amount of non-soldering of the perimeters of the outer surfaces of the tubes in the areas of their engagement with the flanged edges of the openings in the plates is reduced to 5–6%, which affects the heat-transfer efficiency of the stack of plates of a heat exchanger by not more than 2–3%.

Furthermore, the manufacture of the disclosed stack of plates for a heat exchange requires but a single automatic line, with the corresponding reduction of the production cost of the stack of heat-exchanger plates owing to the lesser cost of the production plant and smaller production space required for its accommodation. It has to be pointed out that in the pilot production, despite reducing the size of the production plant, the overall productivity has remained practically the same.

It is expedient that each transition zone joining the portions of the shaping surfaces of the die rolls of the rotary die set should include a zig-zag groove made in the shaping surface of the respective die roll axially thereof, the sectional profile of the groove being conjugated with the profile of the section of the roll in a plane perpendicular to the geometric axis of the roll.

By having the transition zones joining the portions of the shaping surfaces of the die rolls made in this way, breakage of the strip stock is precluded as the zig-zag profile of one portion is offset with respect to the zig-zag profile of the previously shaped portion.

BRIEF DESCRIPTION OF THE DRAWINGS

The objects and advantages of the present invention will become apparent from the following description of its embodiment, with reference made to the accompanying drawings wherein.

BEST MODE TO CARRY OUT THE INVENTION

Figure 1:
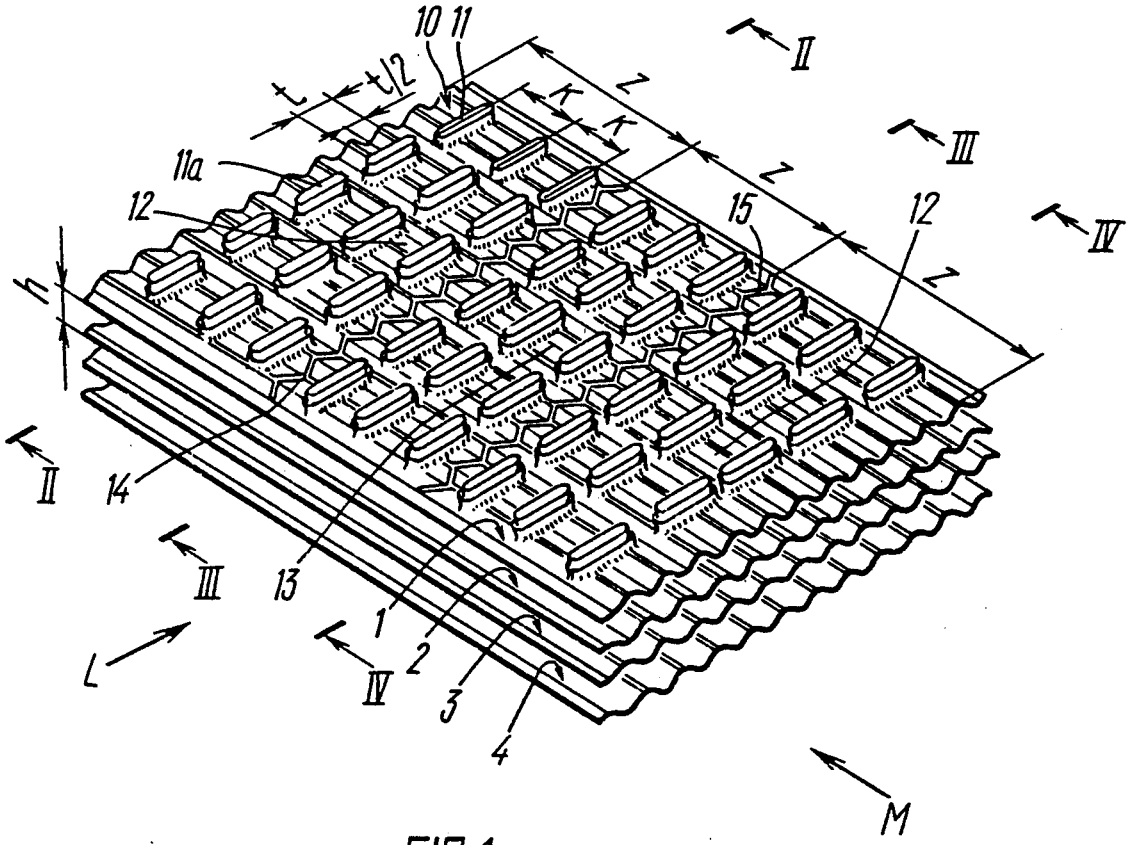
FIG. 1 shows schematically in a perspective general view a stack of plates for a plate-and-tube heat exchanger with converging-diverging passages, embodying the invention.
Figure 2:
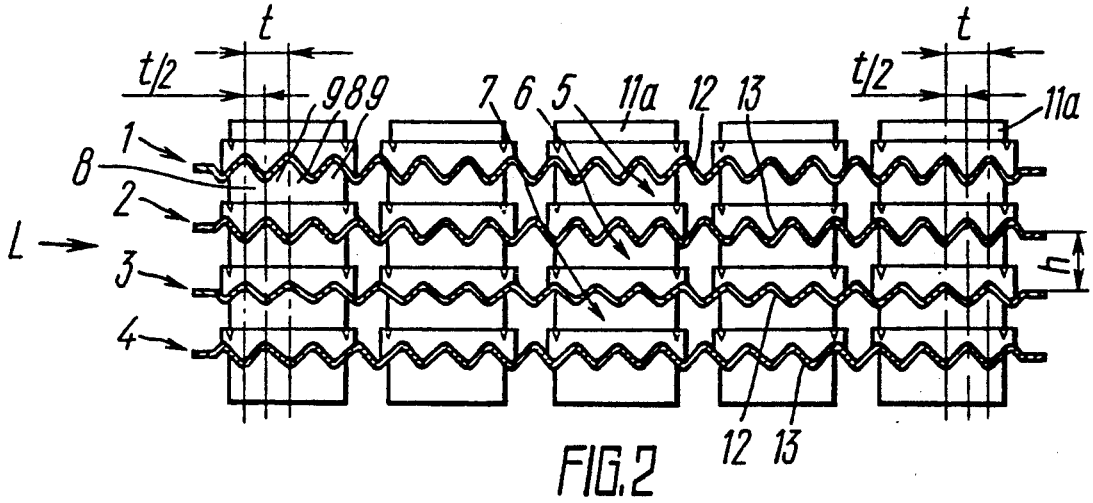
FIG. 2 is a sectional view taken on line II—II of FIG. 1.
Figure 3:
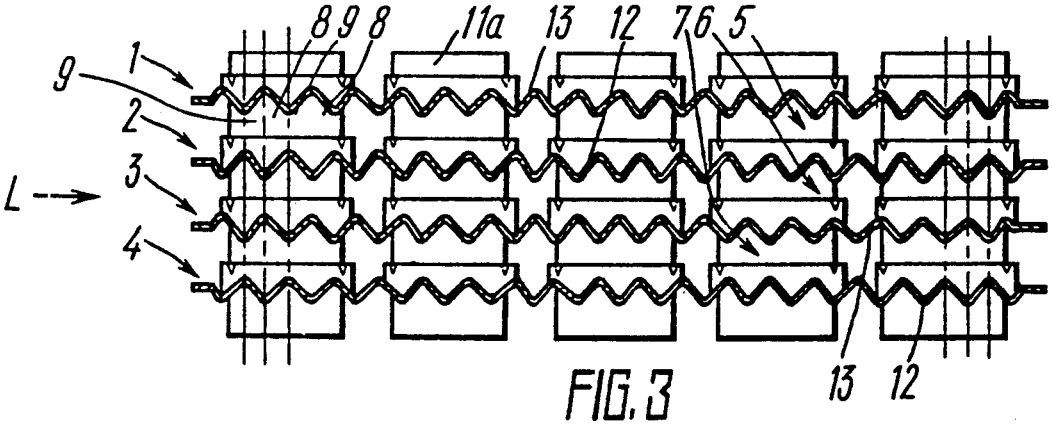
FIG. 3 is a sectional view taken on line III—III of FIG. 1.
Figure 4:
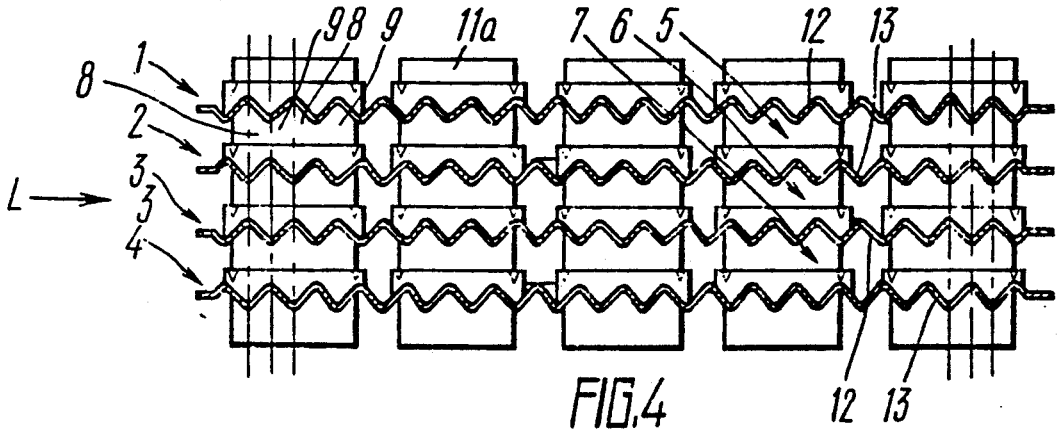
FIG. 4 is a sectional view taken on line IV—IV of FIG. 1.

The disclosed structure of a stack of plates for a plate-and-tube heat exchanger with diverging-converging passages, e.g. incorporated in the radiator of the cooling system of the engine of a tractor or a combine harvester, comprises a plurality of stacked plates 1 (FIG. 1), 2,3 and 4. Each plate 1,2,3 and 4 has a zig-zag profile and defines in the direction L of the flow of the cooling air (the first medium or heat carrier in the heat exchanger) passages 5 (FIG. 2), 6 and 7 for its flow. The profile of each passage 5,6 and 7 in the air flow direction L is defined by a succession of diverging (diffusor) and converging (confusor) portions 8 and 9, respectively. Each plate 1,2,3 and 4 has in the direction M (FIG. 1) perpendicular to the direction L of the air flow at least one row of uniformly spaced, at spacing K, openings 11. In the embodiment being described, there are five such rows 10 of openings 11. The openings 11 accommodate therein tubes 11*a* for the flow of the other heat-exchange medium or heat-carrier, which in the presently described embodiment is water. Each plate 1,2,3 and 4 has an uneven number of portions 12,13 of the same length Z in the direction M perpendicular to the air flow direction L. The zig-zag profile of the portion 12 (FIG. 2) of the plate 1 is offset through a transition zone 14 (FIG. 1) disposed between the adjacent portions by one half of the pitch "t" of the zig-zag pattern with respect to the adjoining portion 13 (FIG. 3) of the same plate 1 in the air flow direction L, and the zig-zag profile of the portion 13 of the plate 1 is likewise offset through the transition zones 14 (FIG. 1), 15 disposed between the adjacent portions with respect to the adjoining portions 12 (FIG. 2, FIG. 4) of the plate 1 by one half of the pitch "t" of the zig-zag pattern in the air flow direction L. The profiles are similarly offset on the plates 2,3 and 4. The length Z of each portion 12,13 is a multiple of the spacing K (FIG. 1) of the openings 11 in one and the same row 10. Thus, the formation of the diverging-converging passages 5,6 and 7 in the stack of plates of the heat exchanger is provided for by the offsetting of the zig-zag profiles of the opposing portion is of the adjacent plates by one half of the pitch "t" of the zig-zag pattern in the direction L of the air flow. In other words, the formation of the diverging-converging passage 5 (FIG. 2) in the stack of plates of the heat exchanger is provided for by the zig-zag profile of the portion 12 of the plate 1 being offset with respect to the zig-zag profile 13 of the plate 2 by one half of the pitch "t" of the zig-zag pattern of the profile. The diverging-converging passages 6 and 7 are formed in a similar manner.

The mass production of the disclosed stack of plates for a plate-and-tube heat exchanger with diverging-converging passages preferably employs an automatic line built about a rotary die set.

Figure 5:
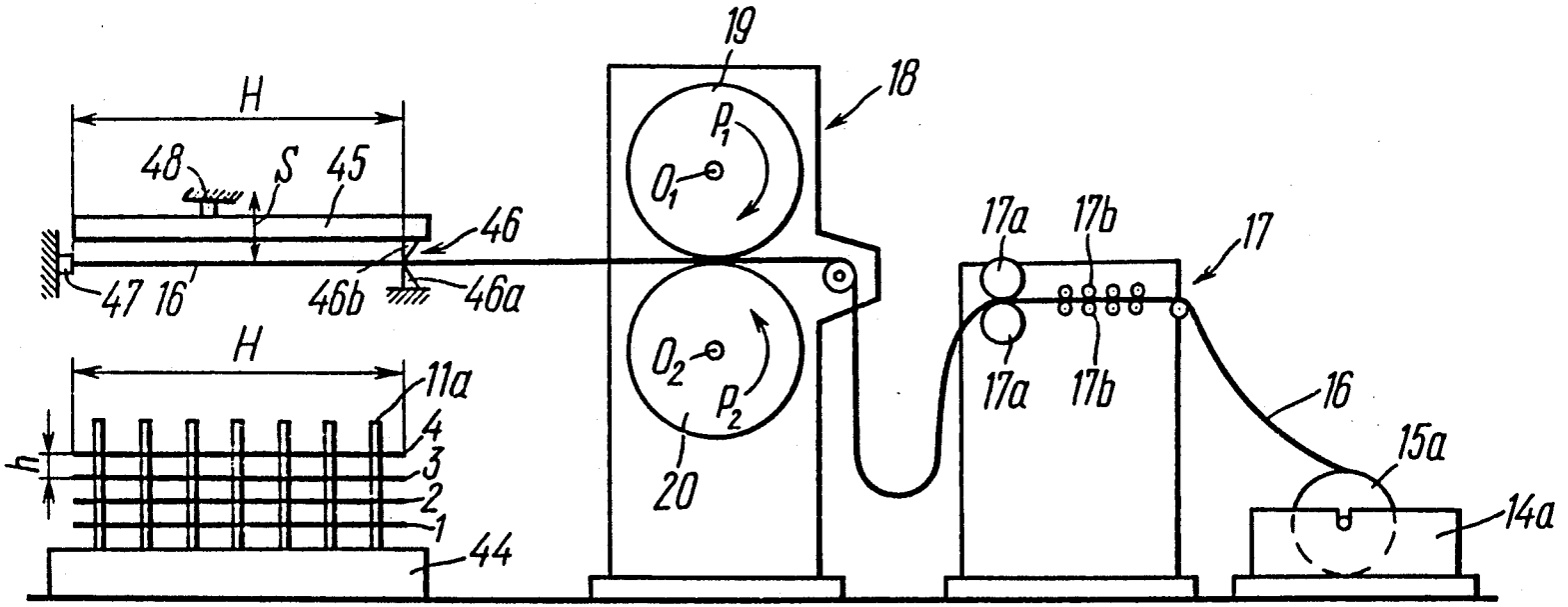
FIG. 5 illustrates schematically the layout of an automatic line for producing a stack of plates for a plate-and-tube heat exchanger with diverging-converging passages, in accordance with the invention.
Figure 6:
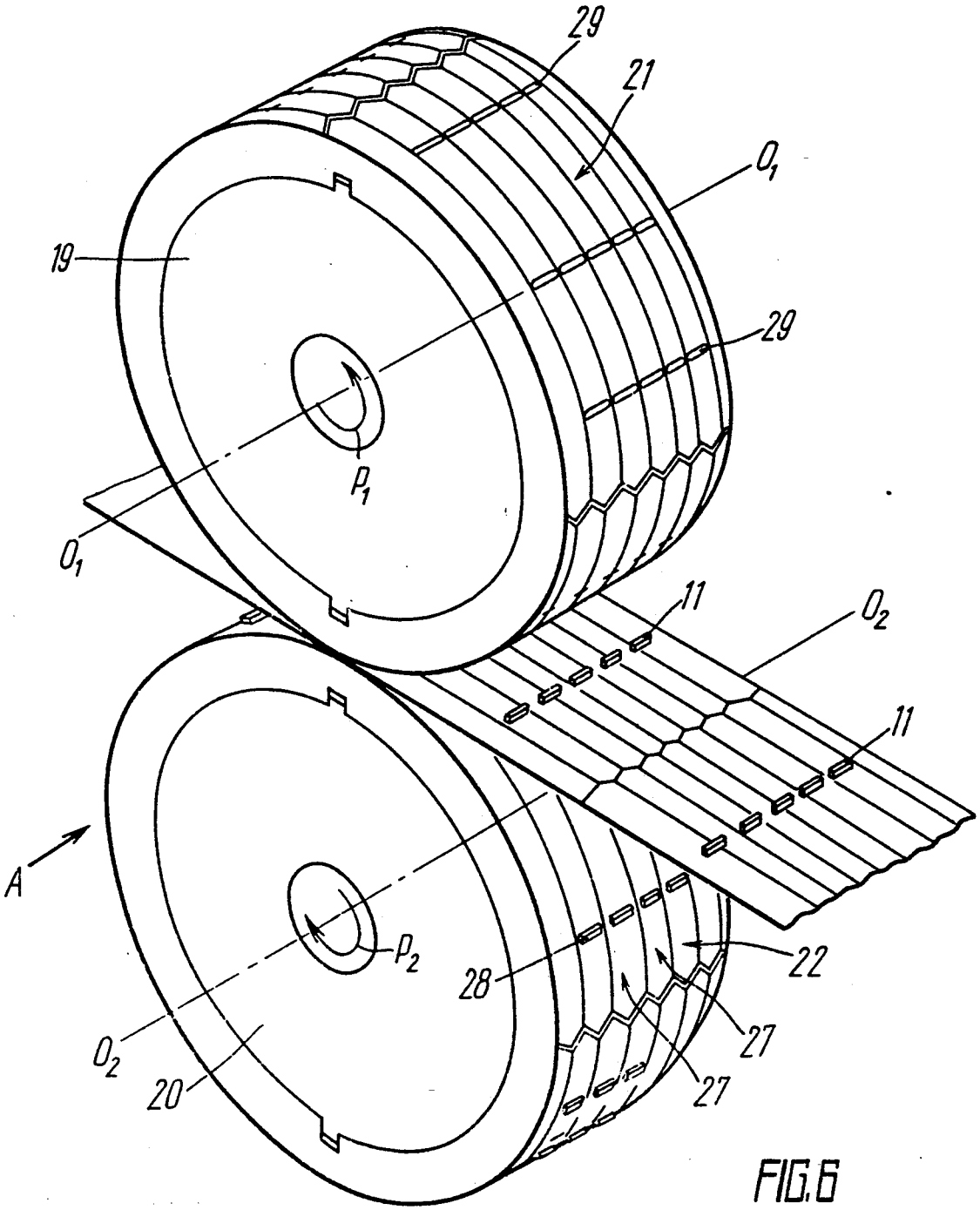
FIG. 6 illustrates on a larger scale in a perspective view a rotary die set in accordance with the invention, incorporated in the automatic production line.
Figure 7:
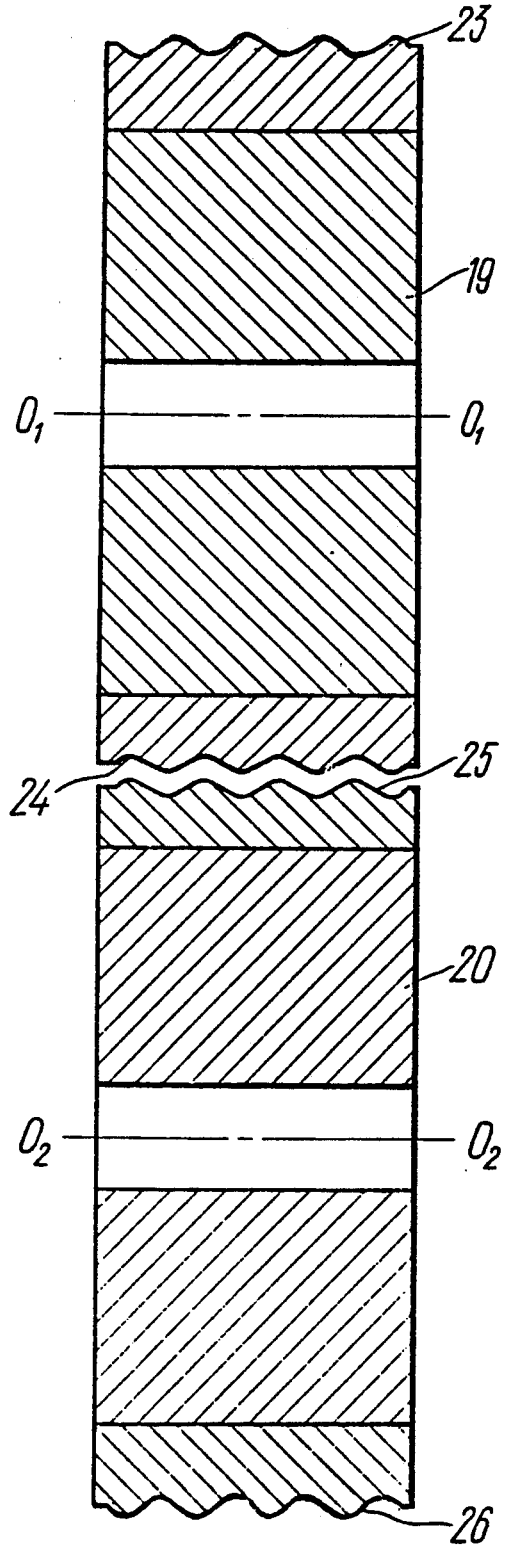
FIG. 7 shows a section of the die rolls of the rotary die set of FIG. 6 by a plane including the geometric axes of the die rolls, in accordance with the invention.

The automatic line comprises a coil holder 14*a* (FIG. 5) with a coil or reel 15*a* of the plain strip stock, operable to pay out the strip 16 off the coil 15*a* in a required duty. The strip 16 is directed from the coil holder 14*a* into the straightening-beading unit 17 where the plain strip 16 is straightened by straightening rollers 17*a* and has its edges rolled-in or beaded by edge-beading rolls 17*b*. Then the plain strip 16 is guided into the rotary die set 18 to have pierced in it a plurality of openings 11 with their edges flanged, simultaneously with the shaping of the zig-zap profile. The rotary die set 18 for producing the plates for a plate-and-tube heat exchanger with diverging-converging passages, in accordance with the invention, includes two die rolls 19 and 20 mounted for rotation in opposite directions $P_1$ and $P_2$ about parallel geometric axes $O_1$—$O_1$ (FIG. 6) and $O_2$—$O_2$, respectively. The die or shaping surface 21 of the die roll 19 and the die or shaping surface 22 of the die roll 20 define in intersection section with a plane including the geometric axes $O_1$—$O_1$ and $O_2$—$O_2$ of respective rolls 19 and 20 zig-zag lines 23 (FIG. 7), 24,25 and 26. The shaping surface 22 (FIG. 6) of the die roll 20 has made thereon along its directrix at least one row 27 of radial male punches 28 uniformly spaced about this shaping surface 22 of the roll 20. In the embodiment being described, there are five rows 27 of the male punches 28. The shaping surface 21 of the other roll 19 has female die recesses 29 matching the above-mentioned male punches 28 of the shaping surface 22 of the roll 20.

Figure 8:
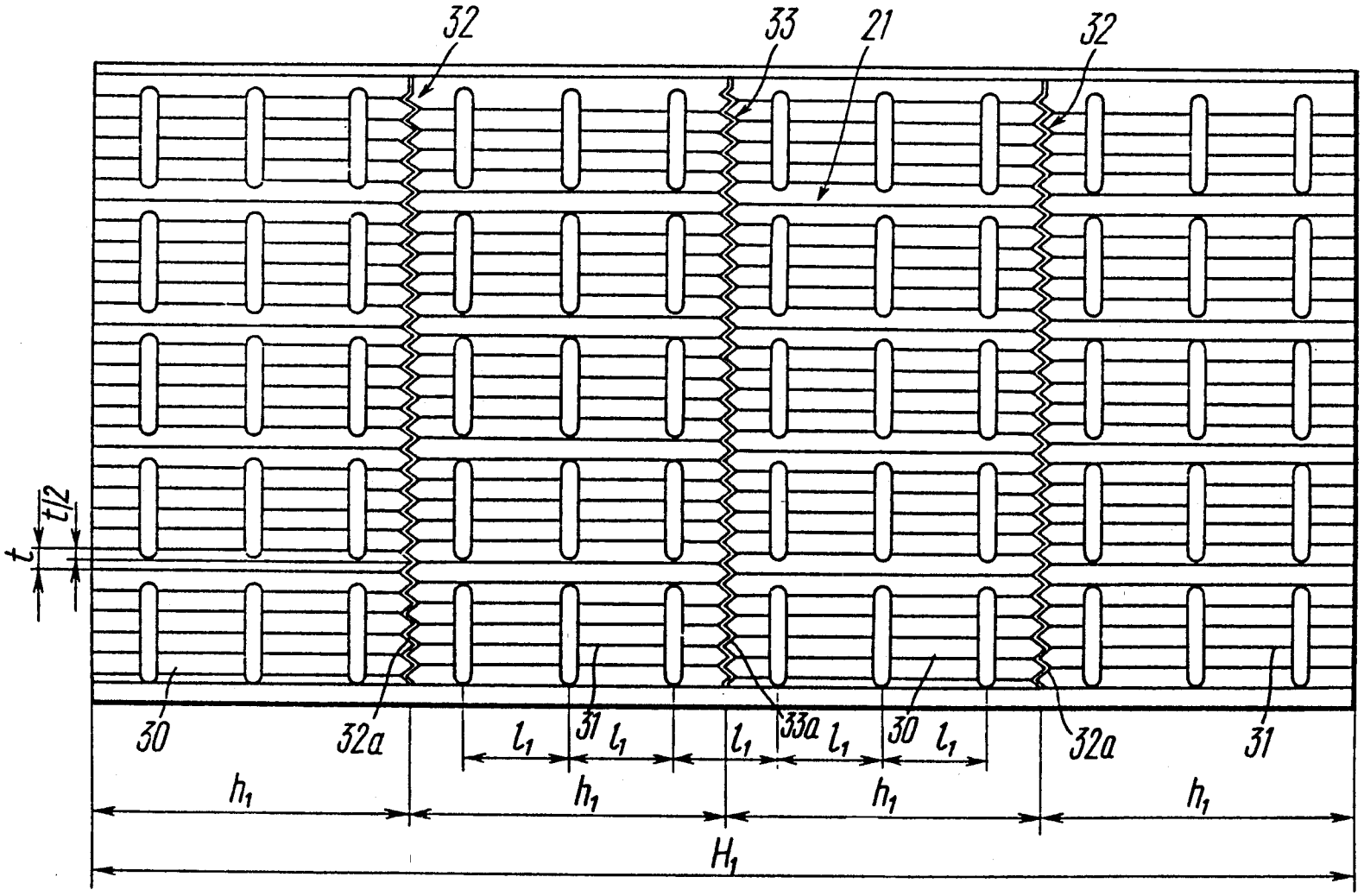
FIG. 8 is an evolution of the shaping surface of the die roll with the female die recesses of the rotary die set in accordance with the invention.
Figure 9:
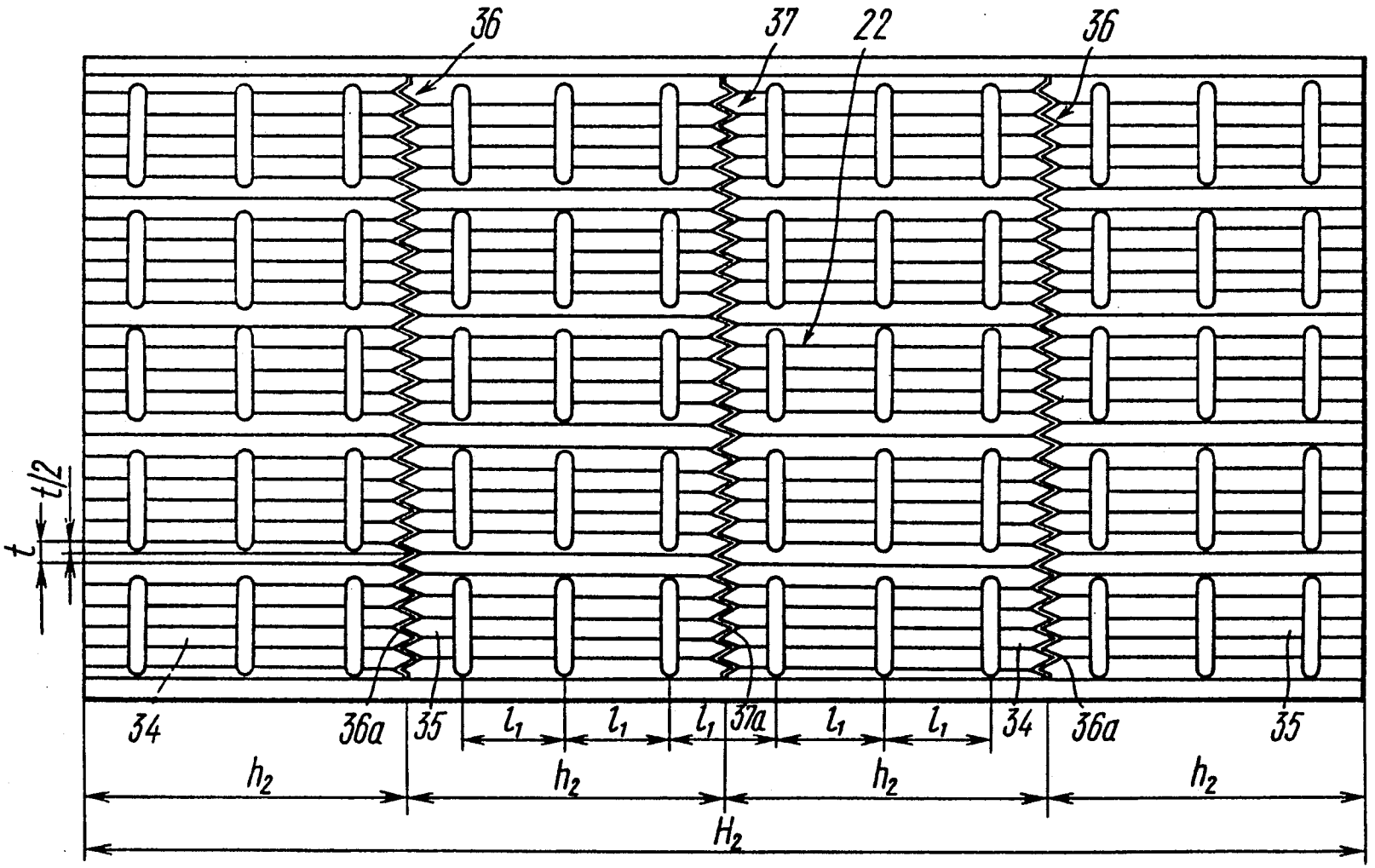
FIG. 9 is an evolution of the shaping surface of the die roll with the male punches of the rotary die set in accordance with the invention.
Figure 10:
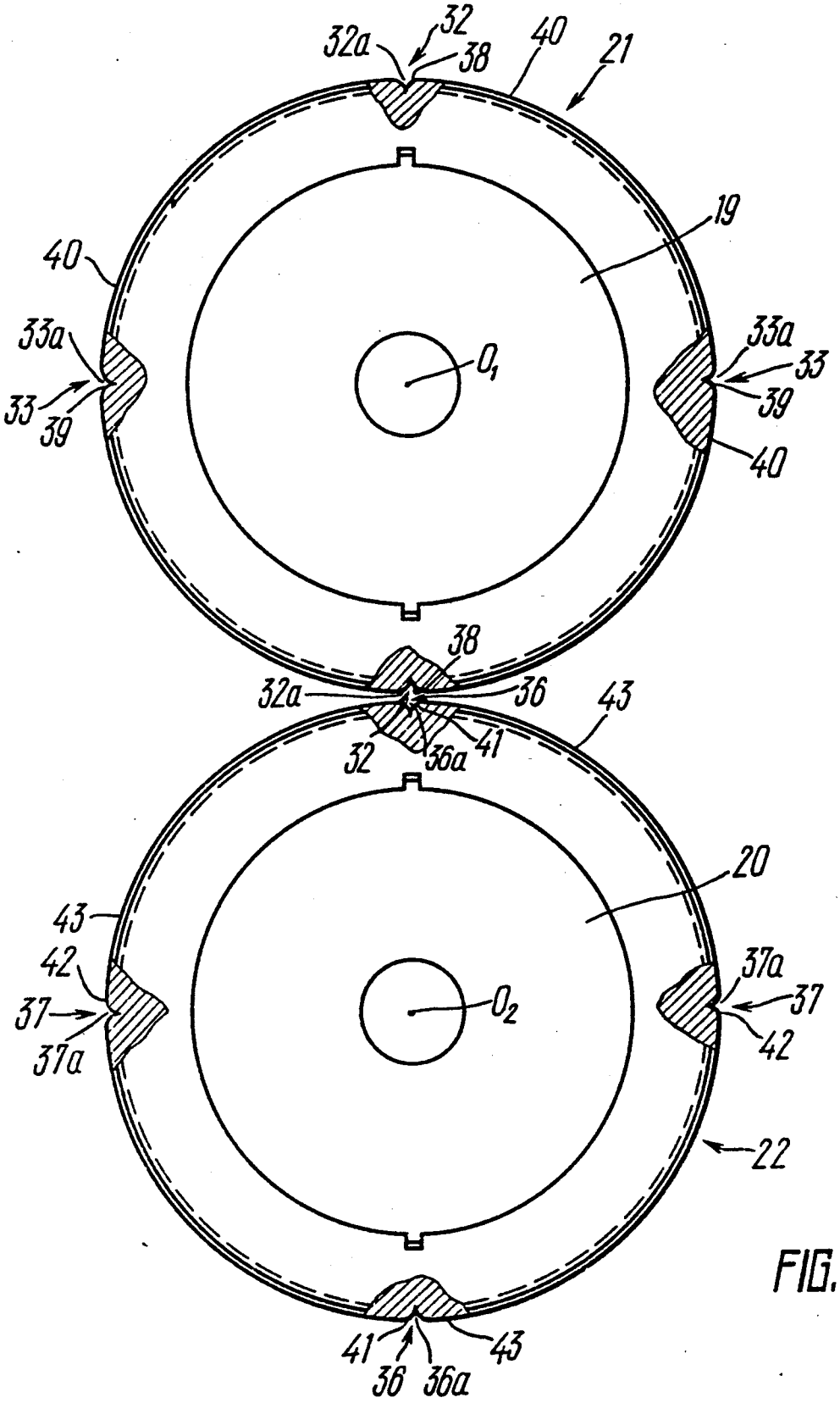
FIG. 10 is a view taken along arrow line A in FIG. 6, partly broken away in the areas of the joining of the adjoining portions.

The length $H_1$ (FIG. 8) of the evolution of the shaping surface 21 of the die roll 19 is divided into an even number of portions 30,31 (four portions in the embodiment being described) of the same length $h_1$ by the zones 32,33 of the joining of the portions 30,31, intended to shape the transition zones 14,15 joining the portions 12, 13 of the plates 1,2,3 and 4. The length $H_2$ (FIG. 9) of the evolution of the shaping surface 22 of the roll 20 is likewise divided into an even number of portions 34,35 of the same length $h_2$ by the zones 36,37 of the joining of the portions 34,35, intended to shape the transition zones 14,15 disposed between adjacent portions 12,13 of the plates 1,2,3 and 4. The zig-zag profile of each portions 31 is offset with respect to the zig-zag profiles of its adjoining portions 30 by one half of the pitch "t" of the zig-zag pattern. The zig-zag profile of the portion 35 is likewise offset with respect to the zig-zag profiles of its adjoining portions 34 by one half of the pitch "t" of the zig-zag pattern. The length $h_1$,$H_2$ of each one of the respective portions 30,31 and 34,35 is a multiple of the spacing $l_1$ of the male punches 28 in one and the same row 27. The portion-joining zones 32,33 of the shaping surface 21 of the die roll 19 and the portion-joining zones 36,37 of the shaping surface 22 of the die roll 20 are zig-zag grooves **32*a*, 33*a*, 36*a* and 37*a*, respectively. The profiles 38 (FIG. 10), 39 of the sections of the grooves 32*a*, 33*a* in the shaping surface 21 of the die roll 19 are conjugated with (or faired to) the profile 40 of the section of the die roll 19 in a plane perpendicular to the geometric axis $O_1$—$O_1$ of this roll 19. The profile 41,42 of the sections of the grooves 36*a*, 37*a* in the shaping surface 22 of the other roll 20 are likewise conjugated with (or faired to) the profile 40 of the section of this roll 20** in a plane perpendicular to its geometric axis $O_2$—$O_2$.

The rotary die set operates, as follows. As the plain strip 16 runs in the nip of the die rolls 19,20 of the rotary die set 18, its plain shape is changed into the zig-zag profile under the action of the portions 30,34 of the shaping surfaces 21,22 of the rolls 19,20. In this way the portions 12 of the zig-zag profile are shaped in the strip 16. As the two rolls 19,20 rotate through 89°, the shaping in the strip 16 of the portion 12 with the zig-zag profile by the portions 30,34 of the respective shaping surfaces 21,22 of the rolls 19,20 is completed, and the zones of the joining of the portions 30 and 31,34 and 35 of the respective rolls 19,20 start shaping in the strip 16 the zone 14 of the joining of the portions 12 and 13 in the strip 16. With the rolls 19,20 having thus rotated through 1°, the shaping of the transition zone 14 joining the portions 12 and 13 in the strip 16 is completed, and the portions 31,35 of the respective shaping surfaces 21,22 of the rolls 19,20 shape the successive portion 13 with the zig-zag profile in the strip 16. As the zig-zag profile of the portion 31 of the shaping surface 21 of the first roll 19 is offset by one half of the pitch "t" of the zig-zag pattern of the profile relative to the zig-zag profile of the adjoining portion 30 of the same shaping surface 21, and the zig-zag profile of the portion 35 of the shaping surface 22 of the other roll 20 is likewise offset by one half of the pitch "t" of the zig-zag pattern relative to the zig-zag profile of the adjoining portion 34 of the same shaping surface 22, the zig-zag profile of the portion 13 in the strip 16 is offset by one half of the pitch "t" of the zig-zag pattern of the profile with respect to the previously shaped portion 12. With the die rolls 19,20 having rotated through other 89°, the transition zones 33,37 joining the portions 30 and 31,34 and 35 of the die rolls 19,20 shape the transition zone 15 joining the portions 12 and 13 in the strip 16. With the rolls 19,20 having rotated through 1° more, the shaping of the transition zone 15 joining the portions 12 and 13 is completed in the strip 16, and the successive portion 12 in the direction of the progress of the strip 16 is being shaped, its zig-zag profile being displaced by one half of the pitch "t" of the zig-zag pattern with respect to the zig-zag profile of the preceding portion 13 of the strip 16 in the direction of its travel, and so on. As the strip 16 is shaped into the zig-zag profile in the abovedescribed manner, the openings 11 are simultaneously pierced and flanged in it. The piercing and flanging of the openings 11 performed by the male punches 28 on the shaping surface 22 of the die roll 20 engaged in the respective matched female die recesses 29 in the shaping surface 21 of the other die roll 19.

The operation of the rotary die set yields the strip 16 of the zig-zag profile with the successively alternating portions 12,13 of the same length, the zig-zag profile of each one of them being offset by one half of the pitch "t" of the zig-zag pattern with respect to the zig-zag profile of the respective preceding portion 13 or 12 in the direction of the travel of the strip 16. Furthermore, there is the transition zone 14 or 15 between each pair of the successive adjacent portions 12 and 13. Altogether, the strip 16 has five rows 10 of the flanged openings 11 uniformly spaced in each row 10.

The thus shaped strip 16 is further guided into the unit where the stack of plates for a plate-and-tube heat exchanger is assembled. In the embodiment being described, the unit for assembling the stack of plates of a plate-and-tube heat exchanger comprises a holder 44 (FIG. 5) in the form of a horizontally arranged plate with rows of vertical blind bores (not shown) arranged to match the openings 11 in the strip 16. Tubes **11*a* are set in advance in these bores, their outer surfaces having been pre-coated with a coat of a solder. Over-lying the holder 44 is a feed carriage 45 which is vertically reciprocable as shown by arrows S in FIG. 5. To cut the continuous strip 16 into the successive plates 1,2,3 and 4, there is used a guillotine 46 with two blades 46*a*, 46*b* of which the blade 46*b* is mounted on the reciprocable carriage 45 and the other blade 46*a* is mounted on the end of the work table (not shown), the other end of the work table accommodating a sensor 47 for initiating commands for halting the rotary die set 18 and driving the reciprocable carriage 45 through its stroke towards the holder 44. The spacing of the sensor 47 and the cutting line of the guillotine 46 equals the required length H of a plate. As the advancing strip 16 engages the sensor 17, the latter initiates the command for halting the rotary die set 18 and driving the feed carriage 45 downwardly towards the holder 44. The guillotine 46 thus cuts the plate 1 off the strip 16, engaged by the descending feed carriage 45 and set by the latter onto the tubes 11*a*, whereafter the feed carriage 45 rises from the holder 44 into engagement with the sensor 48 which initiates a command for halting the carriage 45 and activating the rotary die set 18. The strip 16 is advanced towards the sensor 47, and the abovedescribed cycle is repeated. It should be pointed out that the feed carriage 45 is operated to set the successive plates 1,2,3 and 4 with the required vertical spacing "h" therebetween. With the abovedescribed stack of plates for a plate-and-tube heat exchanger with diverging-converging passages having been assembled on the holder 44, the latter is transported into a sintering oven (not shown) where the solder coat on the outer surface of the tubes 11*a* secures the latter to the plates 1,2,3 and 4**.

It should be stressed once again that the flanged openings 11 in the adjacent plates 1,2,3 and 4 in the stack for a heat exchanger are formed by the male punches 28 and female die recesses 29 of the respective die rolls 20 and 19 of one and the same rotary die set 18. Hence, the accuracy of the matching alignment of the opposing openings 11 in the adjacent pairs of the plates 1,2,3 and 4 is adequately high, as any misalignment is defined by the single tolerance zone of the arrangement of the male punches 28 and female die recesses 29 on the shaping surfaces 22,21 of the rolls 20,19. Thus, when the plates 1,2,3,4 are set on the tubes 11*a*, the non-engagement of the flanged edges of the openings 11 of the plates 1,2,3,4 with the outer surfaces of the tubes 11*a* is minimized. Consequently, the value of the non-sintering of the tubes 11*a* with the flanged edges of the openings 11 of the plates 1,2,3,4 is likewise minimized, which enhances the thermal or heat-transfer efficiency of the heat exchanger.

INDUSTRIAL APPLICABILITY

The invention can be implemented to utmost advantage in water-to-air, air-to-oil and gas-to-air heat exchangers of vehicles and fixed power plants, in systems for heating and air-conditioning of the vehicle interiors. The invention can be also implemented in systems for heating and air-conditioning of industrial buildings, in condensers and evaporators of refrigeration machines, e.g. of the freon type.

The implementation of the present invention in the design of the stack of plates for a plate-and-tube heat exchanger with diverging-converging passages enhances the heat-transfer efficiency of the stack by 10–13% and reduces it s production cost owing to one cost of the manufacturing equipment being halved, with the corresponding saving of the production space.

We claim:

1. A stack of plates for a plate-and-tube heat exchanger with diverging-converging passages, comprising a plurality of stacked plates (1,2,3,4) having a zig-zag profile and defining in the direction (L) of low of a first heat-exchange medium the passages (5,6,7) for its flow, the profile of each passage (5,6,7) being a succession of alternating diverging and converging portions (8,9), each plate (1,2,3,4) having in the direction (M) perpendicular to the flow direction (L) of the first medium at least one row (10) of uniformly spaced (K) openings (11) accommodating therein tubes (11*a*) for the flow of a second heat-exchange medium, wherein each plate (1,2,3,4) has in the direction (M) perpendicular to the flow direction (L) of the first medium an odd number of adjacent portions (12,13) of the same length (Z), the zig-zag profile of each portion (12,13) being offset with respect to the zig-zag profile of each adjacent portion (13,12) of the same plate (1,2,3,4) by one half of the pitch (t) of the zig-zag pattern of the profile in the flow direction (L) of the first medium, and communicating with the adjacent portions (13,12) through a transition zone (14,15) disposed between adjacent portions (12,13), the length (Z) of each portion (12,13) being a multiple of the spacing (K) of the axes of the openings (11) in the same row (10).

* * * * *